US005473167A

United States Patent [19]

Minnis

[11] Patent Number: 5,473,167

[45] Date of Patent: Dec. 5, 1995

[54] SENSITIVITY TEST SYSTEM FOR PHOTOELECTRIC SMOKE DETECTOR

[75] Inventor: David A. Minnis, Montgomery, Ill.

[73] Assignee: BRK Brands, Inc., Aurora, Ill.

[21] Appl. No.: 184,208

[22] Filed: Jan. 21, 1994

[51] Int. Cl.[6] ..... G01N 15/06

[52] U.S. Cl. ..... 250/573; 340/630

[58] Field of Search ..... 250/573, 574, 250/575; 340/628, 629, 630; 356/438

[56] References Cited

U.S. PATENT DOCUMENTS 4,238,788 12/1980 Rosauer ..... 340/629
4,321,466 3/1982 Mallory et al. ..... 340/630
4,471,346 9/1984 Nelson et al. ..... 250/574
4,845,474 7/1989 Moore et al. ..... 340/629

*Primary Examiner*—Stephone B. Allen
*Attorney, Agent, or Firm*—Dressler, Goldsmith, Shore & Milnamow, Ltd.

[57] ABSTRACT

A photoelectric smoke detector has test circuitry for testing the detector by increasing the sensitivity thereof. The sensitivity is increased by either altering a bias condition of a photosensor or by altering a gain parameter of the detector. The detector returns to a quiescent state when the sensor returns to its original bias condition or when the gain parameter returns to its quiescent value.

7 Claims, 2 Drawing Sheets

SENSITIVITY TEST SYSTEM FOR PHOTOELECTRIC SMOKE DETECTOR

FIELD OF THE INVENTION

The invention pertains to smoke detectors. More particularly, the invention pertains to photoelectric-type smoke detectors which incorporate a test feature.

BACKGROUND OF THE INVENTION

Smoke detectors have been recognized as important safety devices which can be used to provide an early alarm indication in the event that the level of smoke in the ambient atmosphere exceeds a predefined threshold. Both ionization-type and photoelectric-type detectors are known and have been used in both residential and commercial applications.

One aspect of smoke detector-type products is that they do not normally go into an alarm condition and are silent until the level of smoke in the ambient atmosphere exceeds the predetermined value. As a result, the great majority of time the detector is in a non-alarmed state and is not emitting an alarm indication.

Test circuits have, as a result, been developed for the purpose of temporarily placing detectors into an alarmed state to establish whether or not the unit is functioning properly. One such circuit is disclosed in Mallory et al. U.S. Pat. No. 4,321,466.

In battery powered photoelectric detectors where the test circuitry increases the radiant energy output of the light source, the batteries are subjected to an increased current draining during the test interval. It is particularly important in battery powered detectors to minimize current draining so as to maximize long-term battery life.

Hence, it would be desirable to provide test circuitry which does not increase the radiant energy output of the light source of a photoelectric detector, so as to enhance and extend battery life by minimizing current draw while in a test condition.

SUMMARY OF THE INVENTION

A photoelectric smoke detector includes a source of radiant energy and a sensor of radiant energy. The source and sensor are positioned in a smoke chamber.

Control circuitry is coupled to the sensor for determining when an output from said sensor indicates a smoke condition. The sensor is biased to provide a first, quiescent level of sensitivity in a non-alarm state.

A test circuit includes a manually operable switch in combination with a bias altering circuit. When the switch is closed, the test circuit alters the bias condition of the sensor increasing the sensitivity of the detector. The control circuitry then enters an alarm state in response to the increased sensitivity.

Alternately, a gain parameter of the detector can be increased in the test condition.

These and other aspects and attributes of the present invention will be discussed with reference to the following drawings and accompanying specification.

DETAILED DESCRIPTION OF THE PREFERRED EMBODIMENT

Figure 1:
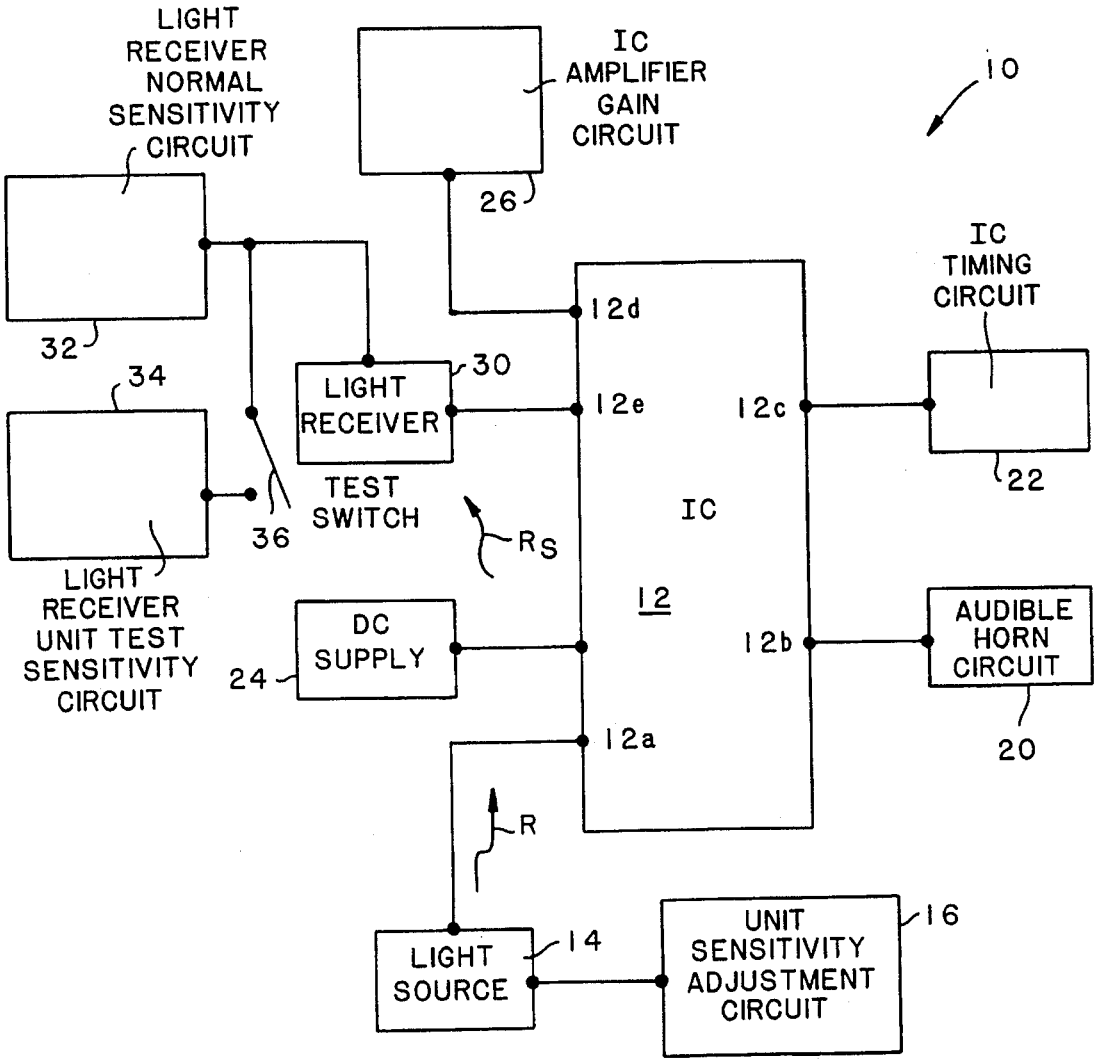
FIG. 1 is a block diagram of a photoelectric detector in accordance with the present invention.

While this invention is susceptible of embodiment in many different forms, there is shown in the drawing, and will be described herein in detail, specific embodiments thereof with the understanding that the present disclosure is to be considered as an exemplification of the principles of the invention and is not intended to limit the invention to the specific embodiments illustrated.

FIG. 1 illustrates a block diagram of a detector 10 which embodies the present invention. The detector 10 includes an integrated circuit 12 which provides control functions.

The integrated circuit 12 could be, for example, a Motorola type MC145011 which is publicly available and used for photoelectric-type smoke detectors. It will be understood that other integrated circuits might be usable. The particular integrated circuit that might be chosen is not a limitation of the present invention.

The integrated circuit 12 includes an output driving port 12*a* for intermittently energizing a light source 14. The output of the source 14 can initially be adjusted during manufacture by a sensitivity adjustment circuit. 16. The source 14 emits radiant energy R into a smoke chamber, not illustrated.

The integrated circuit 12 also includes an alarm indication output port 12*b* which is coupled to a horn driving circuit 20. One type of horn that could be used is a piezoelectric horn used with smoke detectors. Timing for the integrated circuit 12 is provided at an input port 12*c* from timing circuitry 22.

A DC supply 24, which could be a 9 volt battery, provides a source of electrical energy for the detector 10. The integrated circuit 12 contains an amplifier for which the gain can be set, via an input port 12*d*, in a gain circuit 26.

Coupled to an input port 12*e* of the integrated circuit 12 is a radiant energy receiver or sensor 30. Radiant energy R emitted from light source 14 is scattered by particulate matter in the ambient air in the smoke chamber and a portion $R_s$ of the scattered ambient radiant energy is incident upon the receiver 30. As the particulate matter in the atmosphere increases, due to the presence of products of combustion, the degree of scattered radiant energy $R_s$ increases thereby providing, when amplified within the integrated circuit 12, an indicium of the presence of combustion.

The radiant energy receiver or sensor 30 is biased under normal conditions by a bias circuit 32. In this condition, the detector has a sensitivity level set in part by the bias condition and partly by the gain of the detector.

A bias altering, sensitivity test circuit 34 can be coupled to the receiver 30 by means of manually operable test switch 36. When the test switch 36 is closed, the bias altering circuit 34 alters the bias of the sensor or receiver 30 and increases the sensitivity of the detector.

This bias alteration is such that an output is produced in response to a quiescent, non-alarm level of incident radiation $R_s$. This output is sufficient to cause the integrated circuit 12 to enter an alarm state and energize the horn circuit 20 producing an audible test output in a response to closure of the switch 36.

Thus, when the switch 36 is closed, the sensitivity of the receiver or sensor 30 is increased so that a smoke indicating signal is provided to the integrated circuit 12 thus placing it into an alarm state. Alternately, instead of altering the bias of the sensor receiver 30, the gain circuit 26 can be altered to provide increased gain in the integrated circuit 12 thereby generating a smoke condition and placing the integrated circuit into an alarm state.

Figure 2:
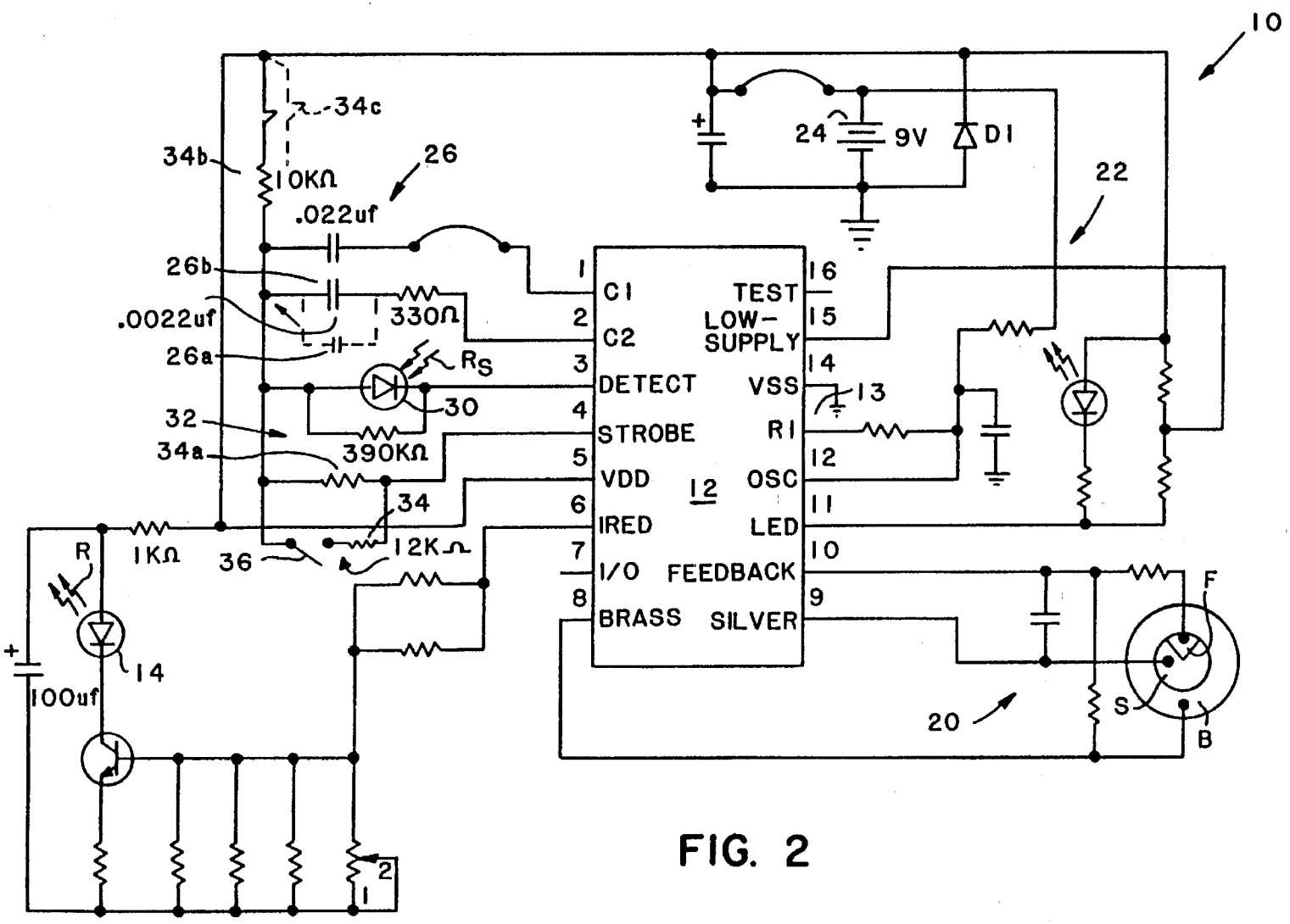
FIG. 2 is a schematic diagram of the detector in accordance with the present invention.

FIG. 2 illustrates portions of the detector 10 in more detail. The same identification numerals are used in FIG. 2 for corresponding circuitry as was discussed above with respect to FIG. 1.

In the embodiment illustrated in FIG. 2, the normal receiver or sensor biasing circuitry is indicated generally at 32. Bias altering circuitry 34 is illustrated coupled to a manually operable test switch 36.

When the switch 36 is closed, the resistor 34 is coupled in parallel across the resistor 34*a* thereby increasing the sensitivity of the detector 10 and driving the integrated circuit 12 into an alarm state. When the switch 36 is released, the receiver or sensor 30 returns to its normal level of sensitivity and exits the alarm state.

Alternately, the gain of the integrated circuit 12 can be increased by coupling a capacitor 26*a*, illustrated in phantom, across one of the gain setting capacitors 26*b*. Increasing the capacitance, results in increased gain in the integrated circuit 12 thereby causing the detector 10 to go into an alarm state.

The bias point of the sensor or receiver 30 can also be shifted by increasing the resistance of resistor 34*b* such as by switching an additional resistance 34*c*, indicated in phantom, in series therewith. This also will increase the sensitivity of the receiver or sensor 30.

Thus, in accordance with the invention, the sensitivity of a sensor or receiver element of a photoelectric smoke detector can be increased thereby placing the detector into an alarm state, for test purposes. When the test switch is released, the unit returns to its normal level or sensitivity.

The sensitivity can be increased by increasing the gain of amplifier circuitry in the detector. Alternately, the bias point of the sensor or receiver can be altered so as to produce a smoke condition signal which is coupled to the integrated circuit control circuitry thereby placing that circuitry into an alarm state.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A photoelectric smoke detector comprising;

a source of radiant energy;

a sensor of scattered radiant energy;

control circuitry coupled to said sensor for determining when an output from said sensor indicates an alarm condition wherein said circuitry has a quiescent state associated with a first level of scattered radiant energy and an alarm state; and a test circuit for increasing a sensitivity parameter of the detector, said test circuit including a manually operable switch with a normal state and a test state in combination with an element from a class including a gain altering circuit and a bias altering circuit wherein said control circuitry enters the alarm state from the quiescent state in the presence of said first level of scattered radiant energy in response to said switch being placed in the test state and enters the quiescent state from the alarm state in response to said switch being placed in the normal state.

2. A detector as in claim 1 wherein said bias altering circuit increases the sensitivity parameter of the unit thereby creating an alarm condition for test purposes in the absence of a sufficient level of products of combustion to create an alarm condition when said switch is in said test state.

3. A detector as in claim 1 wherein said sensor is biased to said quiescent, non-alarm, state in part by a first, bias establishing, resistor coupled thereto, when said test switch is in said normal state and wherein said sensor is biased to an alarm state by a second, bias altering resistor coupled to said test switch, when said switch is in said test state such that said level of scattered radiant energy which is incident on said sensor, when said switch is in said normal state, and which is insufficient to cause said control circuitry to indicate an alarm condition, will cause said control circuitry to indicate an alarm condition when said switch is in said test state.

4. A method of testing a photoelectric smoke detector comprising:

generating a beam of radiant energy;

detecting a scattered portion of the beam;

establishing a non-alarm condition based on a first level of detected scattered energy;

establishing an alarm condition based on a second level of detected scattered energy being indicative of a predetermined level of combustion;

testing the detector by manually altering, in the detecting step, a selected condition wherein the detector enters an alarm state in response to the test condition without altering the radiant energy beam and in response to the first level of scattered energy.

5. A photoelectric smoke detector comprising;

a source of radiant energy;

a sensor of scattered radiant energy;

control circuitry coupled to said sensor for determining when an output from said sensor indicates an alarm condition wherein said circuitry has a quiescent state and alarm state; and a test circuit for altering a quiescent state, bias condition of said sensor for increasing a sensitivity parameter of the detector, said test circuit including a bias altering circuit and a manually operable switch with a normal state and a test state wherein said switch is coupled to said bias altering circuit, wherein said bias altering circuit is coupled to said sensor and wherein said quiescent state bias condition of said sensor is altered when said switch is in said test state thereby increasing said sensitivity parameter and as a result, said control circuitry enters said alarm state from said quiescent state and wherein said quiescent state bias condition returns, causing said control circuitry to return to said quiescent state from said alarm state, in response to said switch being placed in said normal state.

6. A photoelectric smoke detector comprising:

a source of radiant energy which emits light;

a sensor of scattered light;

a control circuit coupled to said source and said sensor wherein said circuit establishes a sensitivity parameter value for a normal, non-alarm condition in response to a predetermined non-alarm level of scattered light and wherein said circuit establishes an alarm condition in response to an alarm-indicating level of scattered light which is greater than said non-alarm level of scattered light; and a test circuit coupled to said control circuit, for intermittently causing said control circuit to enter said alarm condition by increasing said sensitivity parameter value, in response to said non-alarm level of scattered light, wherein said test circuit includes a test switch having a normal state, corresponding to said non-alarm condition and a test state wherein said test state does not alter said non-alarm level of scattered light, and wherein when said switch is in said test state, said value of said parameter sensitivity is increased thereby causing said control circuit to enter said alarm condition in the presence of said non-alarm level of scattered light.

7. A method of testing a photoelectric smoke detector comprising:

generating a beam of radiant energy;

detecting a scattered portion of the radiant energy beam;

establishing a non-alarm condition based on detecting a first level of scattered radiant energy;

establishing an alarm condition based on detecting a second, higher, level of scattered radiant energy, indicative of a predetermined level of combustion;

testing the detector by manually altering, in the detecting step, a selected parameter used in establishing the non-alarm condition wherein the detector enters an alarm state in response to testing while still detecting the first level of scattered radiant energy.

* * * * *